US011632851B2

(12) United States Patent
Jindo et al.

(10) Patent No.: US 11,632,851 B2
(45) Date of Patent: Apr. 18, 2023

(54) PLASMA EXPOSURE DEVICE

(71) Applicant: FUJI CORPORATION, Chiryu (JP)

(72) Inventors: Takahiro Jindo, Anjo (JP); Toshiyuki Ikedo, Nagoya (JP); Shinji Takikawa, Anjo (JP); Akihiro Niwa, Anjo (JP)

(73) Assignee: FUJI CORPORATION, Chiryu (JP)

( * ) Notice: Subject to any disclaimer, the term of this patent is extended or adjusted under 35 U.S.C. 154(b) by 347 days.

(21) Appl. No.: 16/770,855

(22) PCT Filed: Dec. 20, 2017

(86) PCT No.: PCT/JP2017/045811
§ 371 (c)(1),
(2) Date: Jun. 8, 2020

(87) PCT Pub. No.: WO2019/123584
PCT Pub. Date: Jun. 27, 2019

(65) Prior Publication Data
US 2020/0396821 A1 Dec. 17, 2020

(51) Int. Cl.
*H05H 1/36* (2006.01)

(52) U.S. Cl.
CPC ..... *H05H 1/36* (2013.01)

(58) Field of Classification Search
CPC ..... H05H 1/36
USPC ..... 362/257, 263
See application file for complete search history.

(56) References Cited

U.S. PATENT DOCUMENTS

2006/0057301 A1 3/2006 Konig
2006/0186094 A1 8/2006 Krink et al.
2012/0152914 A1 6/2012 Matsuura
2014/0091066 A1 4/2014 Enyedy et al.
2017/0001255 A1 1/2017 Winn

FOREIGN PATENT DOCUMENTS

JP 4-114561 U 10/1992
JP 2000-343220 A 12/2000
JP 2012-129356 A 7/2012
WO WO-2012153332 A3 * 7/2013 ..... A61B 18/042

OTHER PUBLICATIONS

International Search Report dated Feb. 27, 2018 in PCT/JP2017/045811 filed Dec. 20, 2017, 1 page.

* cited by examiner

*Primary Examiner* — Britt D Hanley
*Assistant Examiner* — Hana S Featherly
(74) *Attorney, Agent, or Firm* — Oblon, McClelland, Maier & Neustadt, L.L.P.

(57) ABSTRACT

A plasma emitting device includes plasma head configured to generate a plasmarized gas and jet the plasmarized gas so generated from a nozzle thereof, a gas supply device configured to supply a gas to the plasma head while controlling a flow rate of the gas, gas tube connecting the gas supply device with the plasma head to constitute a gas flow path, and pressure detector configured to detect a pressure of the gas supplied from the gas supply deice. Pressures of gases which are supplied to the plasma head are detected for use for various purposes, whereby the practical plasma emitting device is made up. Specifically, for example, a head clogging, which is a clog impeding a gas flow in the plasma head, can be determined without difficulty based on the detected pressure.

4 Claims, 5 Drawing Sheets

PLASMA EXPOSURE DEVICE

TECHNICAL FIELD

The present application relates to a plasma emitting device for emitting a plasmarized gas.

BACKGROUND ART

For example, as described in the following patent literature, a plasma emitting device includes a plasma head for jetting a plasmarized gas, which is gas that has been converted into plasma, so as to emit the plasmarized gas onto a surface of a workpiece. A reaction gas that constitutes a source of a plasmarized gas, and a carrier gas for carrying the reaction gas are supplied from a gas supply device to the plasma head through a gas tube. The plasma head includes a pair of electrodes, and voltage is applied between the electrodes so that the reaction gas passing between the electrodes is converted into plasma. The plasmarized gas and the carrier gas are jetted from a nozzle of the plasma head.

PATENT LITERATURE

Patent Literature 1: JP-A-2012-129356

BRIEF SUMMARY

Technical Problem

The plasma emitting device described above has been underdevelopment, and hence, by making some improvement thereto, the practicality of the plasma emitting device can be improved. The present disclosure has been made in view of these situations, and an object of the present disclosure is to provide a highly practical plasma emitting device.

Solution to Problem

For solving the above mentioned problems, according to the present disclosure, there is provided a plasma emitting device including: a plasma head configured to generate a plasmarized gas and jet the plasmarized gas from a nozzle; a gas supply device configured to supply a gas to the plasma head while adjusting a flow rate of the gas; a gas tube configured to connect the gas supply device and the plasma head to constitute a flow path for the gas; and a pressure detector configured to detect a pressure of a gas supplied from the gas supply device.

Advantageous Effects

According to the present disclosure, the pressure of the gas supplied to the plasma head can be detected, and the pressure so detected can be used for various purposes. Therefore, according to the present disclosure, the practical plasma emitting device can be provided. Specifically, for example, a head clogging, which is a clog impeding a gas flow in the plasma head, can be determined without difficulty based on the detected pressure.

DESCRIPTION OF EMBODIMENT

Figure 1:
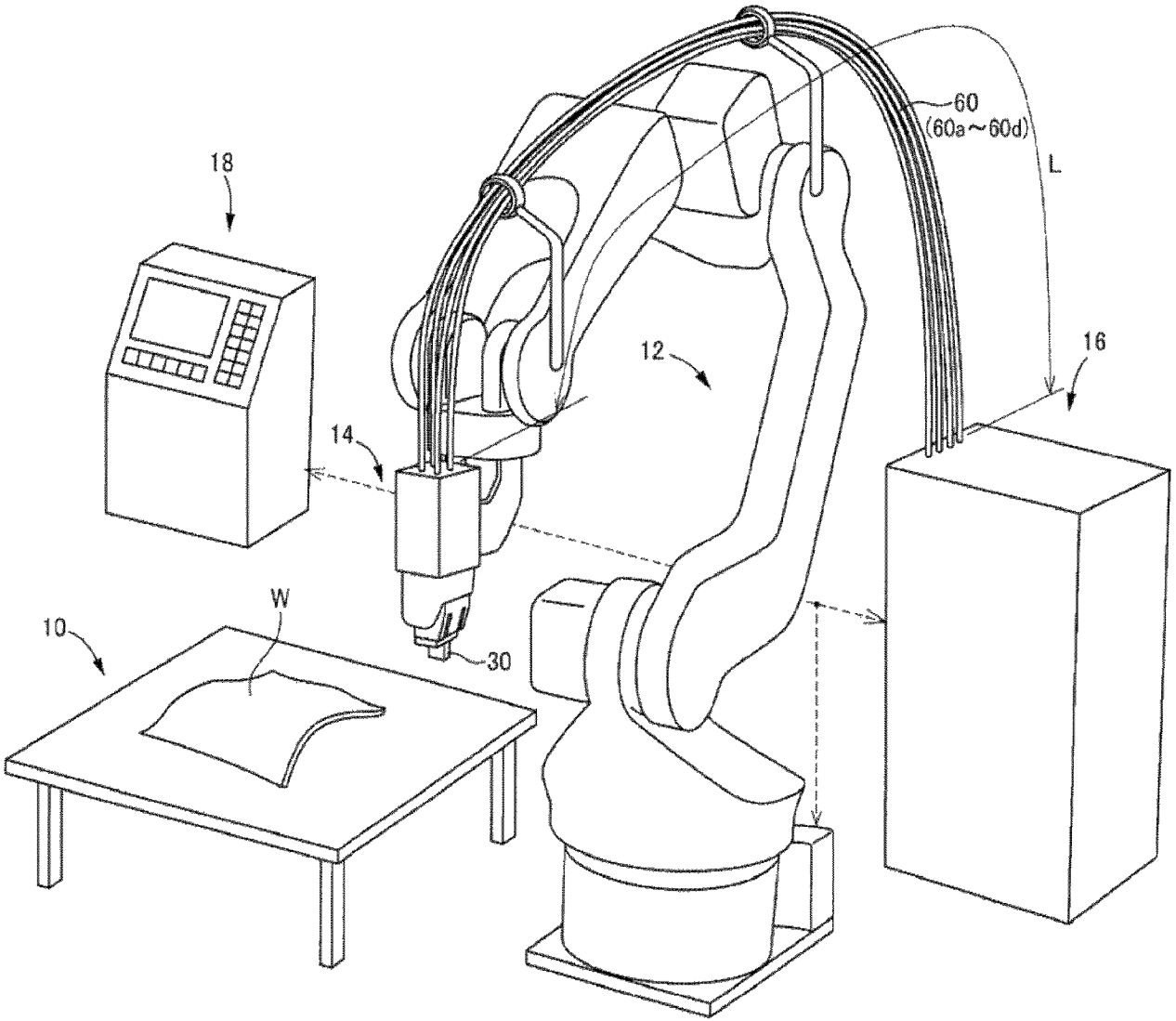
FIG. 1 is a perspective view showing an overall configuration of a plasma treatment machine which is a plasma emitting device of an embodiment.

Hereinafter, referring to the drawings, a representative mode for carrying out a plasma emitting device of the present disclosure will be described in detail as an embodiment thereof. The present disclosure can be carried out in various forms which are modified and/or improved variously based on the knowledge of those skilled in the art to which the present disclosure pertains.

Embodiment

[A] Overall Configuration of Plasma Emitting Device

A plasma treatment machine, which constitutes an embodiment of a plasma emitting device of the present disclosure, includes, as shown in FIG. 1, table 10 on which a workpiece is rested, serial link robot (i.e., "a jointed-arm robot", and hereinafter, simply called as "a robot") 12 disposed close to table 10, emitting head 14 held by robot 12, which is functioning as a plasma head for emitting a plasmarized gas, power and gas supply unit 16 configured to supply electric power to emitting head 14 and supply a gas to emitting head 14, and controller 18 functioning as a control device for managing the control of the plasma treatment machine. Incidentally, robot 12 functions as a head moving device for moving emitting head 14 so that a workpiece is exposed to the plasmarized gas.

Figure 2:
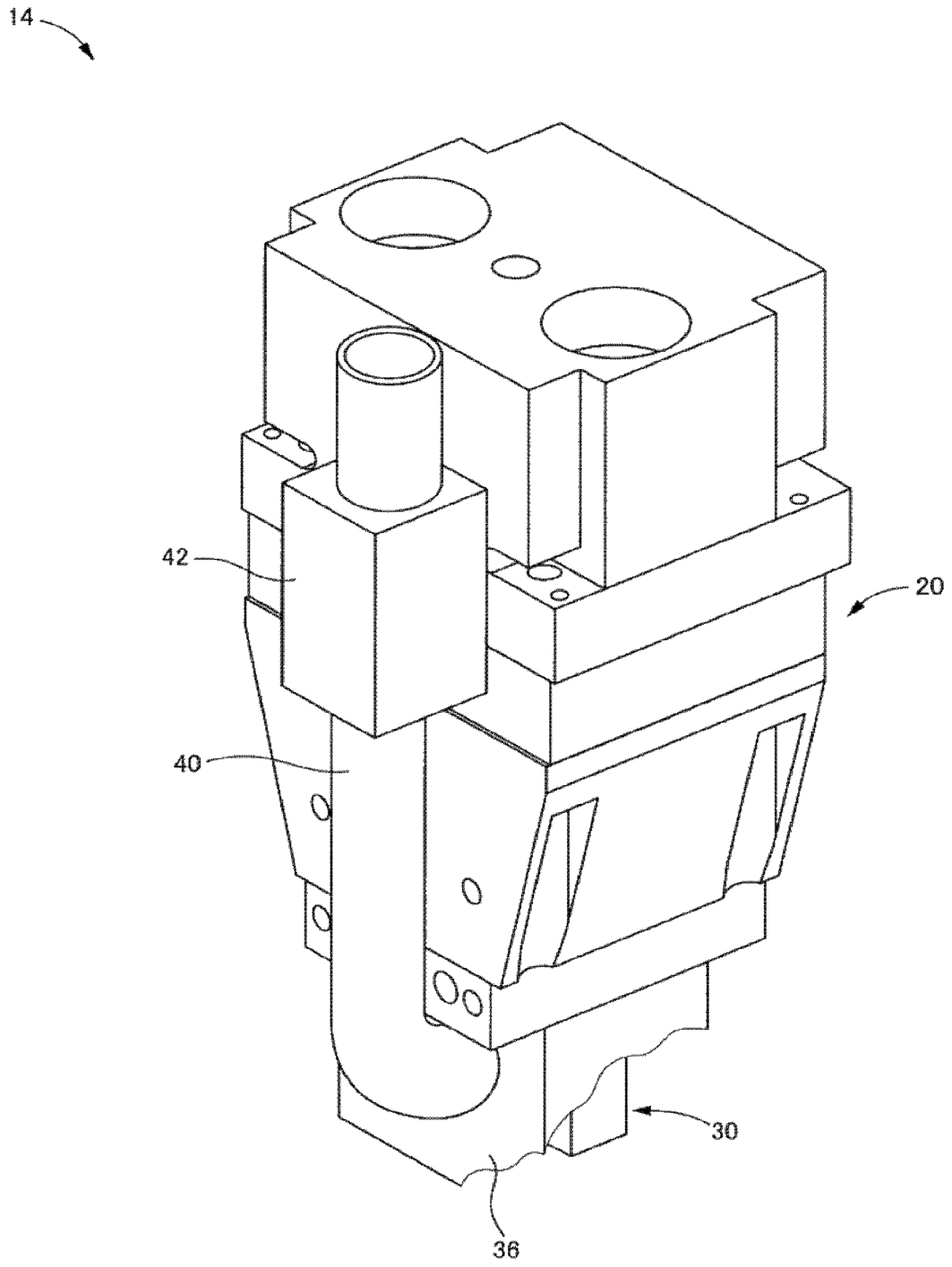
FIG. 2 is a perspective view showing an emitting head, which is a plasma head of the plasma treatment machine shown in FIG. 1, with a cover removed.
Figure 3:
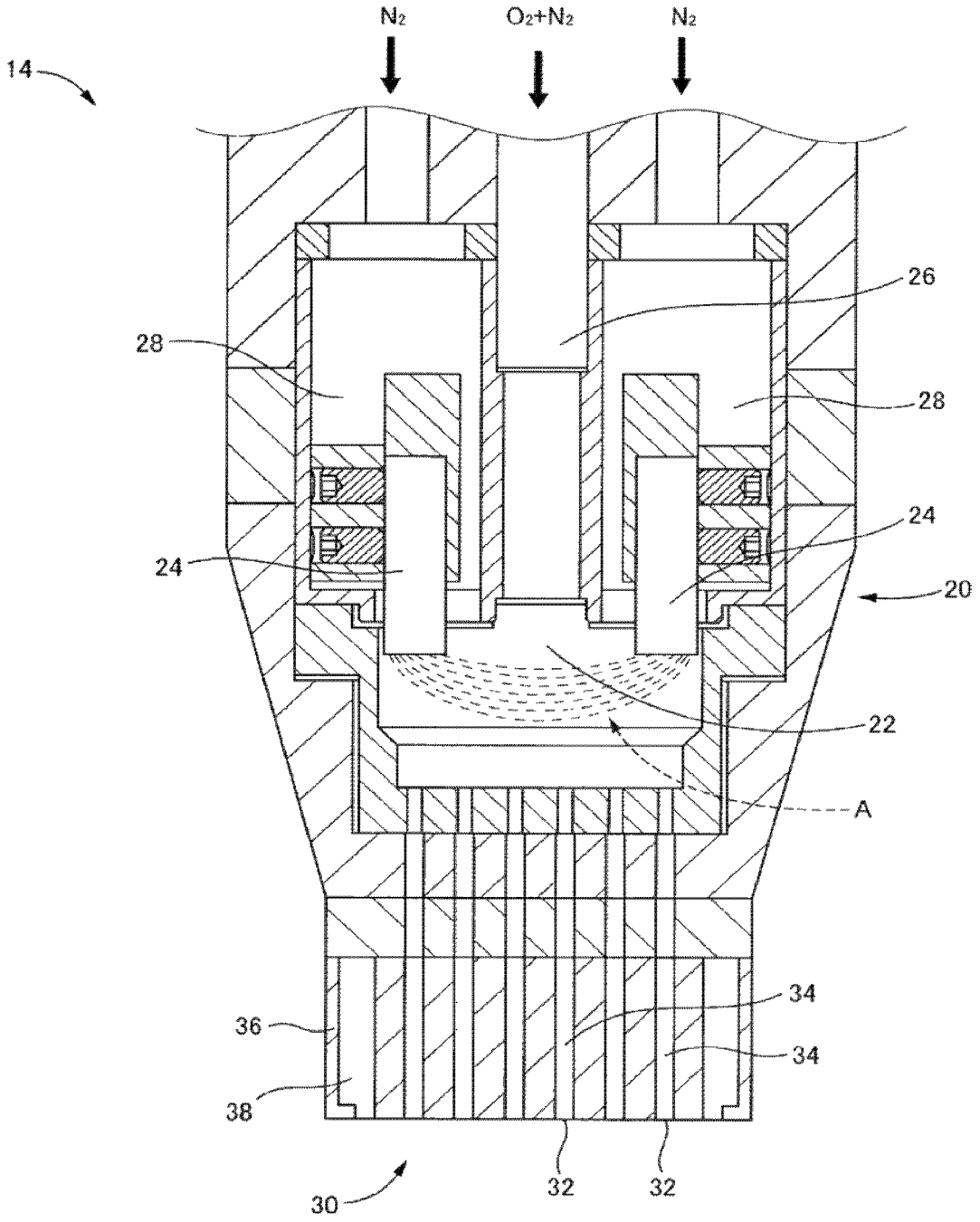
FIG. 3 is a sectional view of the emitting head shown in FIG. 2.

Referring to FIG. 2 showing emitting head 14 with a cover removed and FIG. 3 showing a cross section thereof, emitting head 14 has housing 20 which is generally formed of ceramics, and a reaction chamber 22 configured to generate a plasmarized gas is formed in an interior of housing 20. Then, pair of electrodes 24 are held in such a manner as to project into reaction chamber 22.

There are formed in the interior of housing 20 reaction gas flow path 26 configured to allow a reaction gas to flow into reaction chamber 22 from above and pair of carrier gas flow paths 28 configured to allow a carrier gas to flow therethrough. Although a reaction gas (a seed gas) is oxygen (O2), a mixture gas of oxygen and nitrogen (N2) (for example, dry air (Air) is caused to flow from reaction gas flow path 26 into a space defined between electrodes 24 (hereinafter, this mixture gas may also be referred to as a "reaction gas" as a matter of convenience, and oxygen may be referred to as a "seed gas"). A carrier gas is nitrogen and is caused to flow from individual carrier gas flow paths 28 in such a manner as to encompass individual electrodes 24. A lower portion of emitting head 14 constitutes nozzle 30, and multiple discharge ports 32 are formed in nozzle 30 in such a manner as to be aligned into a row. Then, multiple discharge paths 34 are formed in such a manner as to extend downwards from reaction chamber 22 so as to connect to corresponding discharge ports 32.

AC voltage is applied to the space defined between pair of electrodes 24 by a power supply section of power and gas supply unit 16. By applying the AC voltage in that way, for example, as shown in FIG. 3, pseudo arc A is generated between respective lower ends of pair of electrodes 24 within reaction chamber 22. When the reaction gas passes through pseudo arc A, the reaction gas is converted into plasma, and a plasmarized gas which is gas that has been converted into plasma is discharged (jetted) from nozzle 30 with the carrier gas.

Sleeve 36 is provided around nozzle 30 in such a manner as to surround nozzle 30. A heat gas (in the plasma treatment machine, air is adopted) as a shield gas is supplied into annular space 38 defined between sleeve 36 and nozzle 30 by way of supply pipe 40, and the heat gas is discharged along a flow of the plasmarized gas jetted from nozzle 30 in such a manner as to encompass the plasmarized gas. As the name implies, the heat gas is heated gas discharged to ensure the efficacy of the plasmarized gas. To make this happen, heater 42 for heating a gas is provided halfway along the length of supply pipe 40.

Figure 4:
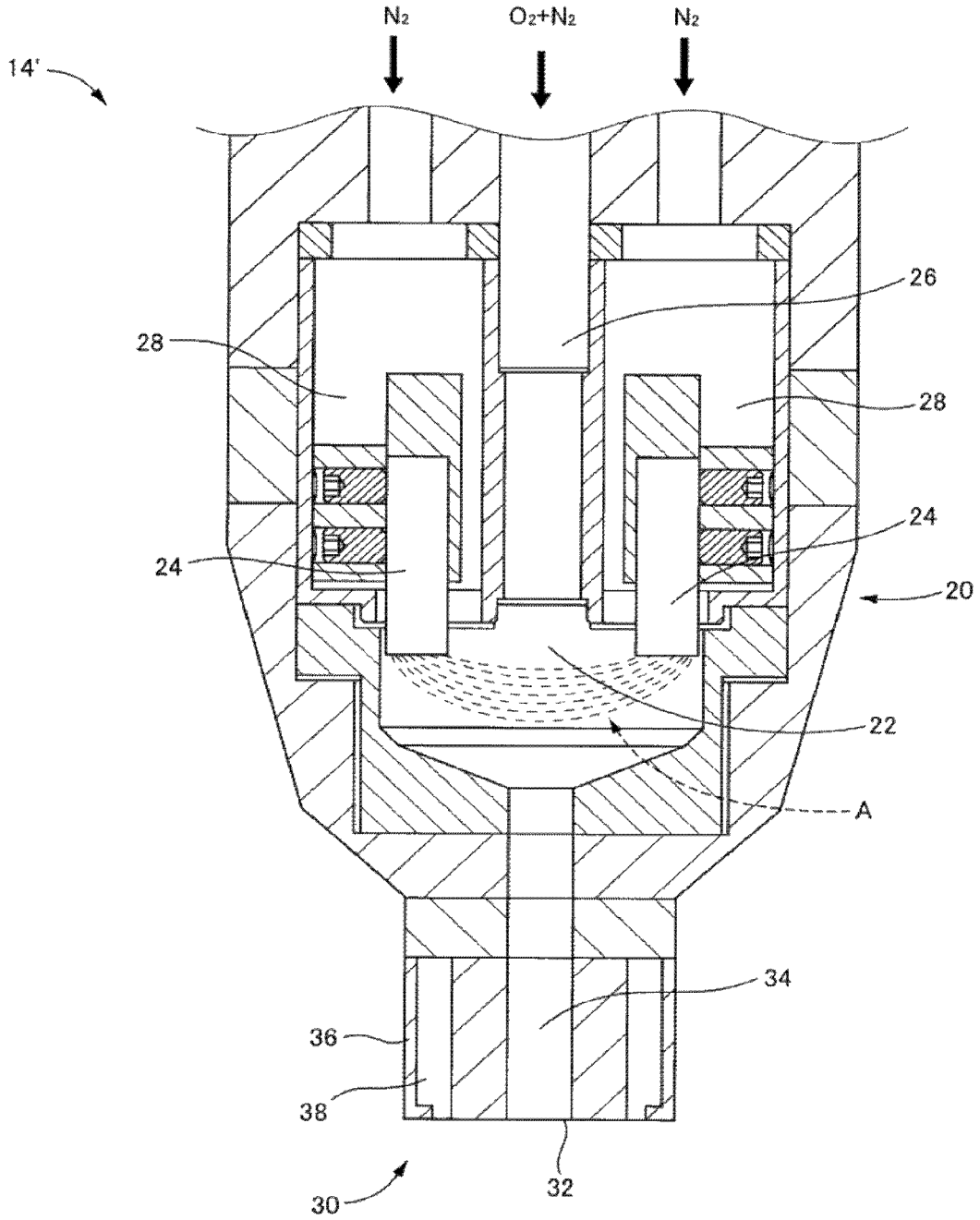
FIG. 4 is a sectional view showing another plasma head which can be attached to the plasma treatment machine shown in FIG. 1.

In the plasma treatment machine, in place of emitting head 14 described above, another plasma head can be attached to the robot. FIG. 4 shows emitting head 14', which is an example of another plasma head. emitting head 14' shown in FIG. 4 has one discharge port 32' of a relatively large diameter which is formed in nozzle 30', and one discharge path 34' is formed in such a manner as to extend downwards from reaction chamber 22 to connect to discharge port 32'. Sleeve 36' and annular space 38' are changed from their counterparts in emitting head 14 in such a manner as to match nozzle 30'. The remaining configuration of emitting head 14' remains similar to that of emitting head 14, and hence, a description thereof will be omitted here. In this way, the different types of plasma heads can be attached to the plasma treatment machine.

Power and gas supply unit 16 includes a power supply section and a gas supply section. The power supply section has a power supply for applying a voltage to the space defined between pair of electrodes 24 of emitting head 14, and the gas supply section configured to function as a gas supply device supplies the reaction gas, the carrier gas, and the shield gas. The supply of the gases by the gas supply section will be described in detail as below.

[B] Supply of Gases

Figure 5:
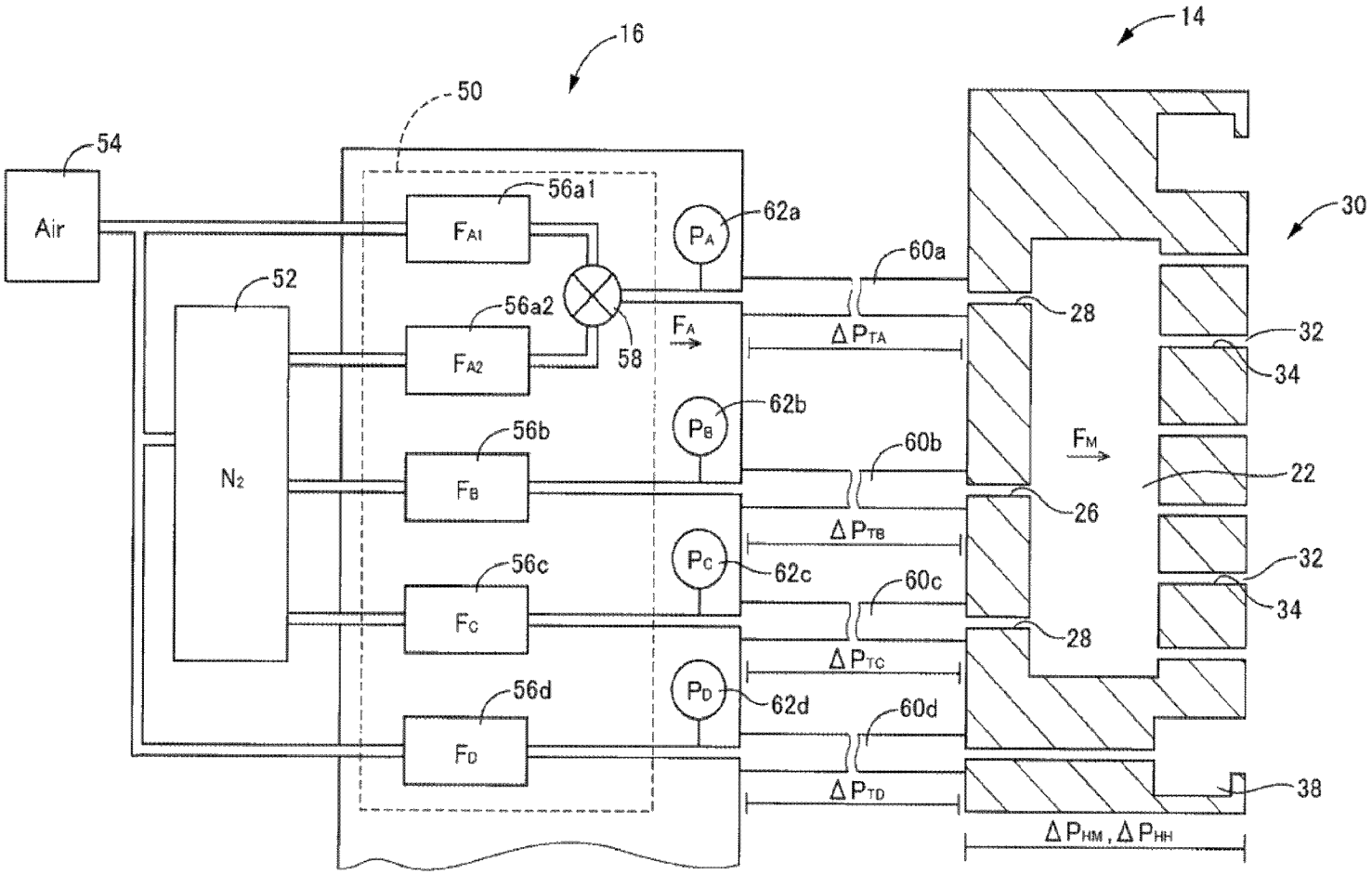
FIG. 5 is a schematic diagram illustrating a configuration of a gas supply mechanism in the plasma head of the plasma treatment machine shown in FIG. 1.

As shown in FIG. 5, nitrogen gas and air are supplied into power and gas supply unit 16, specifically speaking, into gas supply section 50 of power and gas supply unit 16 from nitrogen gas generation device 52 constituting a supply source of nitrogen gas (N2) and compressor 54 constituting a supply source of air (Air) (for example, dry air), respectively. Incidentally, nitrogen gas generation device 52 is configured so as to separate nitrogen gas from air supplied from compressor 54.

Gas supply section 50 has mass flow controllers 56, each functioning as a flow rate controller, which are provided individually for air (Air) containing oxygen as a seed gas of a reaction gas, nitrogen gas (N2) as a reaction gas, nitrogen gas (N2) which is divided into carrier gas used for two systems, namely pair of carrier gas flow paths 28 of emitting head 14, and air (Air) as a heat gas. As an explanatory convenience, when these five mass flow controllers 56 need to be distinguished from one another for a specific description, mass flow controllers 56 will be referred to as mass flow controllers 56*a*1, 56*a*2, 56*b* to 56*d*. Air whose flow rate is controlled by mass flow controller 56*a*1 and nitrogen gas whose flow rate is controlled by mass flow controller 56*a*2 are mixed together by mixer 58 to thereby generate a reaction gas (N2+O2).

A reaction gas, two systems of carrier gas, and a heat gas are supplied to emitting head 14 by way of four gas tubes 60 (also, refer to FIG. 1). Incidentally, hereinafter, gas tubes 60 may be simplified as "tubes 60" from time to time, and when four gas tubes 60 need to be distinguished from one another for a specific description, gas tubes 60 may often be referred to individually as gas tubes 60*a* to 60*d*. A reaction gas and two systems of carrier gas which are supplied via tubes 60*a* to 60*c* are mixed together in reaction chamber 22 inside emitting head 14, and a plasmarized mixture gas containing oxygen is discharged from nozzle 30, 30'. Pressure sensors 62, which are pressure detectors, are provided near ends of four tubes 60 which face corresponding mass flow controllers 56 inside power and gas supply unit 16 to detect pressures of gases flowing into four tubes 60. In other words, pressure sensors 62 are provided between corresponding tubes 60 and gas supply section 50. Incidentally, when four pressure sensors 62 need to be distinguished from one another for a specific description, pressure sensors 62 will be referred to as pressure sensors 62*a* to 62*d*. It can also be considered that mass flow controllers 56*a*1, 56*a*2 and mixer 58 make up one gas supply device, while mass flow controllers 56*b* to 56*c* individually make up separate gas supply devices so as to correspond individually to tubes 60.

[C] Determination on Clogging in Emitting Head and Gas Tubes

Clogging in a gas flow makes it difficult to carry out a plasma treatment with a good condition by emitting a plasmarized gas. Clogging can occur, for example, in nozzles 30, 30' of emitting heads 14, 14', annular spaces 38, 38' for heat gas, and tubes 60 when tubes 60 are collapsed. In the plasma treatment machine of the present disclosure, controller 18 is configured to determine occurrence of such clogging.

FIG. 5 schematically shows a state in which emitting head 14 is attached to robot 12, and as is seen from the figure, a pressure loss is generated in each of tubes 60, and also in emitting head 14, a pressure loss is generated in a system of the carrier gas and the reaction gas (herein after, also referred to as a "main gas system"), as well as in a system of the heat gas (hereinafter, also referred to as a "heat gas system"). When respective pressure losses in tubes 60*a* to 60*d* are referred to as tube pressure losses ΔPTA to ΔPTD; a pressure loss in the main gas system in emitting head 14 is referred to as a main gas system head pressure loss ΔPHM, and a pressure loss in the heat gas system in emitting head 14 is referred to as a heat gas system pressure loss ΔPHH, actual pressures PA to PD which are gas pressures detected by pressure sensors 62*a* to 62*d*, respectively, are $$PA=\Delta PTA+\Delta PHM,$$

$$PB=\Delta PTB+\Delta PHM,$$

$$PC=\Delta PTC+\Delta PHM, \text{ and}$$

$$PD=\Delta PTD+\Delta PHH.$$

When gas flow rates (mass flow rates per unit time) which are controlled by mass flow controllers 56*a*1, 56*a*2, 56*b* to 56*d* are referred to as FA1, FA2, FB to FD, respectively, the relevant gases flow in corresponding tubes 60*a* to 60*d* at flow rates of A(=FA1+FA2) to FD. Assuming that tube pressure losses ΔPTA to ΔPTD in individual tubes 60 in the cases of the relevant gases flowing properly through corresponding tubes 60 are referred to as reference tube pressure losses ΔPTA0 to ΔPTD0, then, these reference tube pressure losses ΔPTA0 to ΔPTD0 are determined respectively as below, based on flow rates FA to FD, of which gases flowing through corresponding tubes 60, and tube length L of tubes 60 (respective lengths of tubes 60 can be considered to be equal to one another in the plasma treatment machine of the present disclosure):

$$\Delta PTA0=fTA(FA,L)=fTA(FA1+FA2,L),$$

$$\Delta PTB0=fTB(FB,L),$$

$$\Delta PTC0=fTC(FC,L), \text{ and}$$

$$\Delta PTD0=fTD(FD,L),$$

where, fTA( ) to fTD( ) express respective functions using flow rates FA to FD and tube length L as parameters.

On the other hand, assuming that main gas system head pressure loss ΔPHM and heat gas system head pressure loss ΔPHH in the cases of the gases flowing properly within emitting head 14 are referred to as reference main gas system head pressure loss ΔPHM0 and heat gas system head pressure loss ΔPHH0, respectively, these reference main gas system head pressure loss ΔPHM0 and reference heat gas system head pressure loss ΔPHH0 are determined based on flow rates of the gases flowing through the main gas system and the heat gas system, that is, main gas system flow rate FM (=FA+FB+FC) and heat gas system flow rate FH (=FD), as well as type Ty of emitting head 14 as below:

$$\Delta PHM0=fHM(FM,Ty)=fHM(FA+FB+FC,Ty)=fHM(FA1+FA2+FB+FC,Ty), \text{ and}$$

$$\Delta PHH0=fHH(FHH,Ty)=fHH(FD,Ty);$$

where, fHM( ) and fHH( ) are functions using flow rates FM, FHH, and head type Ty as parameters.

Controller 18 stores the data for obtaining reference tube pressure losses ΔPTA0 to ΔPTD0, reference main gas system head pressure loss ΔPHM0, and reference heat gas system head pressure loss ΔPHH0 in the form of functions fTA( ) to fHM( ) and fHH( ) described above, or in the form of matrix data for each of flow rates FA to FD whose values are discretely set, tube length L, flow rates FM, FHH, and head type Ty, obtains reference tube pressure losses ΔPTA0 to ΔPTD0, reference main gas system head pressure loss ΔPHM0, and reference heat gas system head pressure loss ΔPHH0 when a plasma treatment is actually being performed or before the plasma treatment is actually performed based on the data so stored, flow rates FA1, FA2, FB to FD of the gases which are actually controlled by mass flow controllers 56*a*1, 56*a*2, 56*b* to 56*d*, respectively, tube length L of each of tubes 60 attached, and type Ty of emitting head 14,14' attached, and obtains reference pressures PA0 to PD0, which constitute reference gas pressures, based on the results of the calculations as below:

$$PA0=\Delta PTA0+\Delta PHM0,$$

$$PB0=\Delta PTB0+\Delta PHM0,$$

$$PC0=\Delta PTC0+\Delta PHM0, \text{and}$$

$$PD0=\Delta PTD0+\Delta PHH0$$

Then, controller 18 compares actual pressures PA to PD, which are detected by pressure sensors 62*a* to 62*d*, respectively, with reference pressures PA0 to PD0 and determines on dogging in nozzles 30, 30' of emitting heads 14, 14' and clogging in annular spaces 38, 38' for the heat gas. Specifically speaking, when actual pressures PA to PC become higher than margin pressures dPA to dPC (set differences) which are set individually for those actual pressures PA to PC, controller 18 determines that dogging is generated in nozzle 30, 30', and controller 18 determines that dogging is generated in annular spaces 38, 38' when actual pressure PD becomes higher than corresponding set margin pressure dPD. That is, controller 18 functions as a determination device for determining the head dogging indicating that a clog is impeding the gas flow in the plasma head.

On the other hand, when only any one of actual pressures PA to PC becomes higher than margin pressures dPA to dPC which are set individually for actual pressures PA to PC, controller 18 determines that dogging is generated in one of tubes 60*a* to 60*c* through which the gas flows whose actual pressure PA to PC is so higher. In the determination based on actual pressure PD, that is, in the determination that actual pressure PD is higher than margin pressure dPD set therefor, controller 18 may determine that dogging is generated in any location in tube 60*d* and the heat gas systems of emitting head 14 or 14'.

REFERENCE SIGNS LIST

14,14': emitting head [Plasma Head]; 16: power and gas supply unit; 18: Controller [Control Device] [Clogging Determination Device]; 22: Reaction Chamber; 24: Electrode; 30, 30': Nozzle; 38, 38': Annular Space; 50: Gas Supply Section [Gas Supply Device]; 56, 56*a* to 56*d*: Mass Flow Controller [Flow Rate Controller]; 60, 60*a* to 60*d*: Gas Tube; 62, 62*a* to 62*d*: Pressure Sensor [Pressure Detector]

The invention claimed is:

1. A plasma emitting device comprising:

a plasma head that generates a plasmarized gas and jet the plasmarized gas from a nozzle;

multiple gas supply devices each supplying a gas to the plasma head while adjusting a flow rate of the gas;

multiple gas tubes each connecting the multiple gas supply devices individually with the plasma head to constitute a flow path for the gas;

multiple pressure detectors detecting a pressure of a gas supplied from each of the gas supply devices; and a clogging determination device that determines a head clogging that impedes a gas flow in the plasma head, wherein the plasma head is configured so as to mix gases supplied from the multiple gas supply devices having passed through the multiple gas tubes, multiple reference tube pressure losses are set individually for the multiple gas tubes, the clogging determination device sets a reference pressure for each of the multiple pressure detectors based on the multiple reference tube pressure losses and a reference head pressure loss, and the clogging determination device determines that the head clogging is generated when all differences between actual pressures detected individually by the multiple pressure detectors and the reference pressures of the multiple pressure detectors exceed a set difference.

2. The plasma emitting device according to claim 1, wherein the pressure detectors are provided between the gas supply devices and the gas tubes.

3. The plasma emitting device according to claim 1, wherein the clogging determination device sets the reference pressure based on a reference tube pressure loss set based on a length of each of the gas tubes and the flow rate of the gas flowing through the gas tubes and the reference head pressure loss which is set based on a type of the plasma head and a flow rate of a gas flowing through the plasma head.

4. The plasma emitting device according to claim 1, wherein when only a difference between an actual pressure detected by one of the multiple pressure detectors and the reference pressure for the one of the multiple pressure detectors exceeds the set difference, the clogging determination device determines that tube clogging, which is gas tube clogging in a gas flow, is generated in one of the multiple gas tubes in which the one of the multiple pressure detectors is provided between the one of the multiple gas supply devices and the one of the gas tubes.

* * * * *